US005342059A

United States Patent [19]

Briem et al.

[11] Patent Number: 5,342,059

[45] Date of Patent: Aug. 30, 1994

[54] BOWLING BOARD GAME APPARATUS

[76] Inventors: Steven W. Briem, 17 Sherry Dr., Syracuse, N.Y. 13219; Joseph A. Figliomeni, 5689 Stevens Dr., Cicero, N.Y. 13039

[21] Appl. No.: 128,585

[22] Filed: Sep. 28, 1993

[51] Int. Cl.[5] ..... A63F 3/00; A63F 9/04

[52] U.S. Cl. ..... 273/277; 273/146

[58] Field of Search ..... 273/277, 298, 259, 146

[56] References Cited

U.S. PATENT DOCUMENTS

| | | | |
|---|---|---|---|
| 2,138,272 | 11/1938 | Feher | 273/298 |
| 2,148,102 | 9/1937 | Brumer | 273/277 |
| 3,055,662 | 9/1962 | Kemp | 273/277 |
| 3,208,754 | 2/1963 | Sieve | 273/146 |
| 4,501,426 | 2/1985 | Seitz | 273/277 |
| 5,165,693 | 11/1992 | Handlon | 273/298 |

FOREIGN PATENT DOCUMENTS

| | | | |
|---|---|---|---|
| 679014 | 12/1991 | Switzerland | 273/298 |

*Primary Examiner*—Benjamin H. Layno

*Attorney, Agent, or Firm*—Harris Beach & Wilcox

[57] ABSTRACT

A bowling board game apparatus includes a deck of action cards, a deck of percentage cards, a pin die with twelve sides, and an action die with twelve sides. Each side of the pin die contains indicia indicating the number of pins knocked down or an instruction that a player is to draw an action card. Each side of the action die contains one of three action commands. The apparatus further includes a matrix chart and a pad of score cards. The matrix chart is employed to determine the number of pins knocked down when a player has been instructed to draw a percentage card.

11 Claims, 4 Drawing Sheets

120

MATRIX CHART

166 NUMBER OF PINS STANDING 164

| | | 1 | 2 | 3 | 4 | 5 | 6 | 7 | 8 | 9 | 10 |
|---|---|---|---|---|---|---|---|---|---|---|---|
| P | 10 | 0 | 0 | 0 | 0 | 0 | 0 | 0 | 0 | 0 | 1 |
| E | 20 | 0 | 0 | 0 | 0 | 1 | 1 | 1 | 1 | 1 | 2 |
| R | 30 | 0 | 0 | 0 | 1 | 1 | 1 | 2 | 2 | 2 | 3 |
| C | 40 | 0 | 0 | 1 | 1 | 2 | 2 | 2 | 3 | 3 | 4 |
| E | 50 | 0 | 1 | 1 | 2 | 2 | 3 | 3 | 4 | 4 | 5 |
| N | 60 | 0 | 1 | 1 | 2 | 3 | 3 | 4 | 4 | 168 5 | 6 |
| T | 70 | 0 | 1 | 2 | 2 | 3 | 4 | 4 | 5 | 6 | 7 |
| A | 80 | 0 | 1 | 2 | 3 | 4 | 4 | 5 | 6 | 7 | 8 |
| G | 90 | 0 | 1 | 2 | 3 | 4 | 5 | 6 | 7 | 8 | 9 |
| E | 100 | 1 | 2 | 3 | 4 | 5 | 6 | 7 | 8 | 9 | 10 |

FIG. 6

122

SCORE CARD

| Name | 1 | 2 | 3 | 4 | 5 | 6 | 7 | 8 | 9 | 10 | Total |
|---|---|---|---|---|---|---|---|---|---|---|---|
| 1ST EX. | 7 | | | | | | | | | | |
| 2ND EX. | 3 | | | | | | | | | | |
| 3RD EX. | 9 | | | | | | | | | | |
| 4TH EX. | | | | | | | | | | | |
| 5TH EX. | 5 8 | | | | | | | | | | |
| 6TH EX. | 1 | | | | | | | | | | |
| | | | | | | | | | | | |
| | | | | | | | | | | | |

FIG.7

BOWLING BOARD GAME APPARATUS

BACKGROUND OF THE INVENTION

1. Field of the Invention

This invention relates in general to parlor games and, in particular, to a board game in which players roll dice and draw cards to simulate the play of bowling in a bowling alley. More specifically, but without restriction to the particular embodiment hereinafter shown and described, this invention relates to a board game that combines the elements of chance and skill attendant the actual play of bowling.

2. Discussion of the Prior Art

The art of parlor games relating to bowling has been contributed to by a number of proposed game devices including, for example, the devices disclosed by G. A. Kemp in U.S. Pat. No. 3,055,662 which issued on Sep. 25, 1962 and by J. J. Brumer in U.S. Pat. No. 2,148,102 of Feb. 21, 1939.

The Kemp bowling game device includes an elongated rectangular board having color coded lane areas in a triangular region with indicia representing ten pin spots in the standard configuration, a pair of color coded, cube-shaped dice, and four decks of corresponding color coded cards. One of the color coded dice indicates a card that provides the results of the first ball in a frame. The second die indicates specific pin lanes. Any remaining pins situated in the lanes that are turned up are deemed knocked over while any remaining pins outside the lanes remain standing.

Ten cube-shaped dice and a shaker cup comprise the Brumer game device. Each cube has one face representing a pin while the remaining faces are blank. The ten cubes are rolled from the shaker cup and if no pins appear face up, a strike is recorded. If any cubes show a pin up, they are rerolled. If on this second roll no pins appear face up, a spare is recorded. Absent a strike or a spare, the number of pins knocked down, as represented by the total of blank faces turned up, is recorded for each frame.

Previous bowling theme parlor games, as exemplified by those discussed above, have included components which result in completely random and unpredictable play. Thus, no game of this type has been proposed that incorporates a component involving some of the elements of skill required in the actual play of bowling in a bowling alley.

OBJECTS AND SUMMARY OF THE INVENTION

It is, therefore, an object of the present invention to provide an amusing and challenging parlor game that combines the elements of chance and skill.

A further object of the present invention is to provide a board game simulating the actual play of bowling in a bowling alley.

It is still another object of the present invention to provide a board game that involves elements of chance with some of the skill required in bowling.

These and other objects are attained in accordance with the present invention wherein there is provided an apparatus for playing a board game in which players skillfully roll dice and draw random cards to simulate the action of bowling in a bowling alley and in which the object of play, in addition to amusement, is to score the highest point total after ten frames of play. In accordance with one aspect of the present invention, there is provided a deck of action cards. Each of the action cards is provided with an action command on its face side. In the preferred embodiment of the present invention, there are three possible action commands including the instructions that the player drawing the card is to record a strike, a miss, or is to draw a card from the deck of percentage cards. In accordance with another aspect of the present invention, the apparatus includes a deck of percentage cards. Each of the percentage cards is provided with a percentage number on its face side. The percentage number is a multiple of ten between ten and one hundred, inclusive.

The game apparatus of the present invention is further provided with a pin die and an action die. The pin die is the first of the two dice to be rolled by a player beginning a frame of play. The pin die is provided with a plurality of sides. Each of the sides of pin die is provided with indicia indicating a number of pins knocked down after a roll of the pin die or indicating that a player is to draw an action card from the deck of action cards. In the preferred embodiment of the present invention, the pin die is a duodecahedron, i.e., a regular polyhedron having twelve sides. Each of nine predetermined sides of the pin die is provided with the indicia indicating the number of pins knocked down. More particularly, each one of these nine predetermined sides is provided with one of nine integers between one and nine, inclusive. Each of the three remaining sides of the pin die is provided with the indicia indicating that a player is to draw a card from the deck of action cards.

The action die of the present invention is also provided with a plurality of sides. Each of the sides of the action die is provided with indicia indicating that the player has rolled a spare, a miss, or is to draw a percentage card from the deck of percentage cards. In the preferred embodiment of the present invention, the action die is also a duodecahedron or regular polyhedron having twelve sides. Each of four first predetermined sides of the action die is provided with the indicia indicating that the player has rolled a spare, each of four second predetermined sides is provided with the indicia indicating that the player has rolled a miss, and, finally, each of the remaining four sides is provided with the indicia indicating that the player is to draw a card from the deck of percentage cards.

In accordance with another aspect of the present invention, the board game apparatus is provided with a matrix chart for determining the number of pins knocked down when a player has been instructed to draw a percentage card from the deck of percentage cards. The preferred embodiment of the matrix chart includes a grid having ten rows and ten columns subdividing the grid into one hundred square regions. Each of the regions is provided with a single integer between zero and ten, inclusive, to indicate the number of pins knocked down. Each of the columns is numbered consecutively one through ten for representing the number of pins that remain standing after a player has been instructed to draw a percentage card from the percentage deck of cards and for ordinally identifying the columns first through tenth. In a similar manner, each of the rows from top to bottom is associated with one of the ten possible percentage numbers.

The game apparatus of the present invention is finally provided with a playing surface upon which the dice are rolled and a pad of several printed score cards similar to those used in scoring the actual play of bowling in a bowling alley.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing, wherein:

FIG. 6 is a plan view of the matrix chart employed in the board game of the present invention; and FIG. 7 is a plan view of a score card employed in the board game of the present invention including the scoring from illustrative examples of play.

DETAILED DESCRIPTION OF A PREFERRED EMBODIMENT

Figure 1:
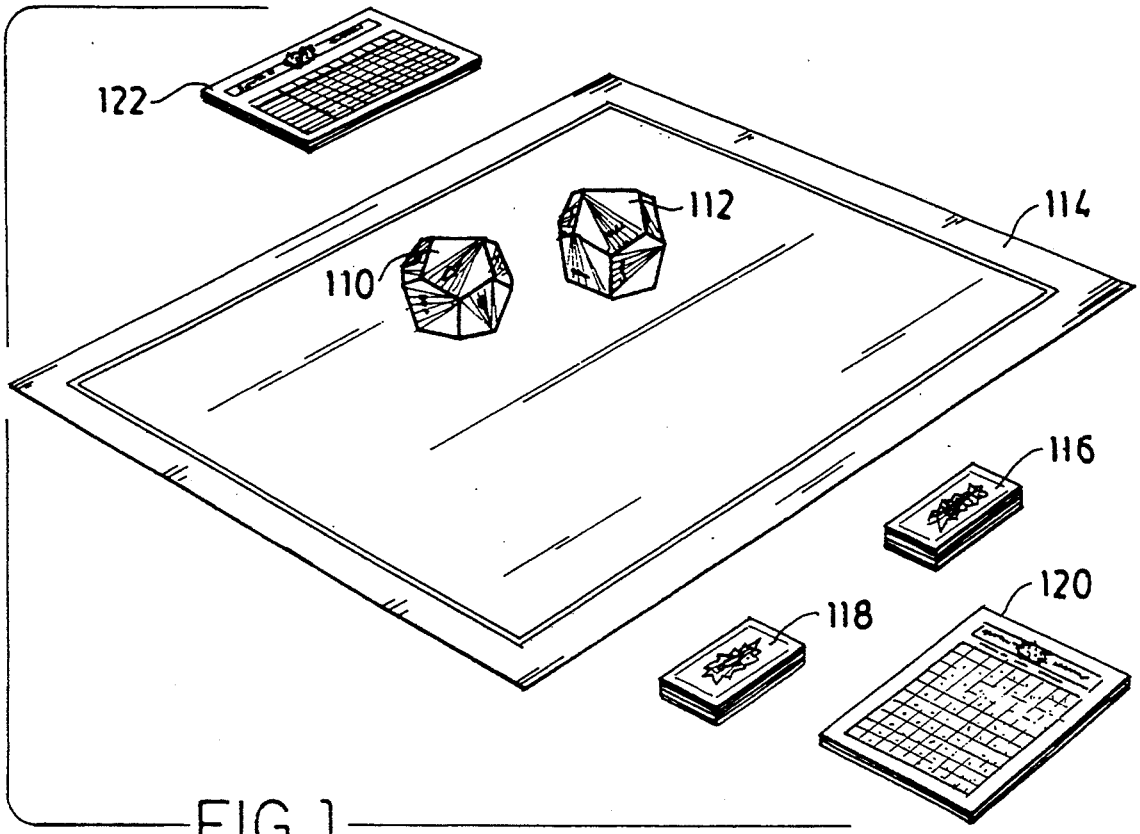
FIG. 1 is a perspective view of the components of the board game apparatus of the present invention.
Figure 2A:
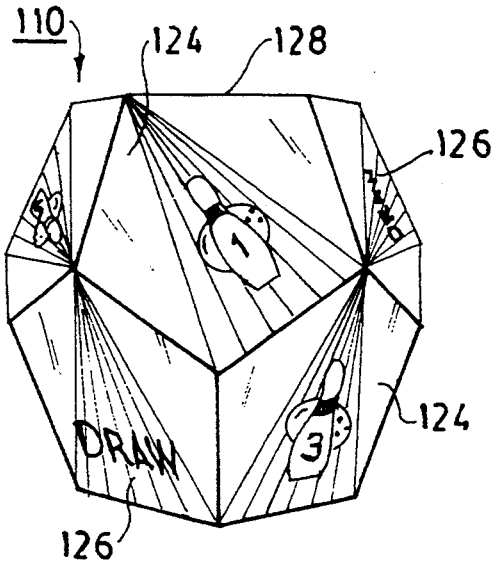
FIGS. 2A and 2B are perspective views of different sides of the pin die employed in the board game of the present invention.
Figure 2B:
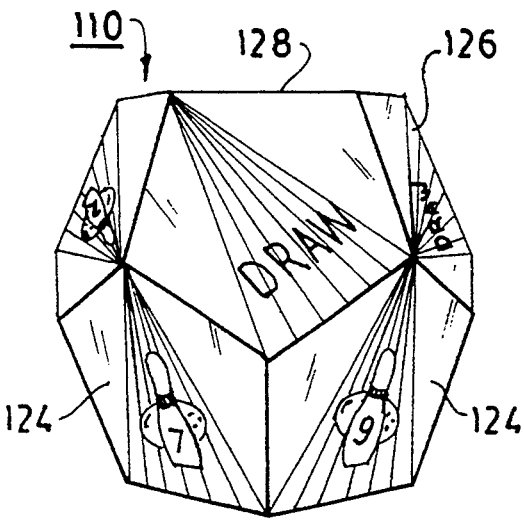

Referring now to the drawing and initially to FIG. 1 thereof, there is shown a bowling game board apparatus in accordance with the present invention which includes a pin die 110, and action die 112, a playing surface 114, a deck of percentage cards 116, a deck of action cards 118, a matrix chart 120 and a pad of score cards 122. FIGS. 2A and 2B show in detail the pin die 110 and several representative sides or faces thereof. The pin die 110 is a regular polyhedron containing twelve sides. Nine of the twelve sides of the pin die 110, as represented by side 124 in FIGS. 2A and 2B, are provided with indicia including one of the integers between one and nine inclusive. The three remaining sides of the pin die, as represented by the sides 126, include indicia indicating that a player is to draw card from the deck of action cards 118. As a result of the regular shape of the pin die 110, after it is rolled and comes to a stop, a side 128 will result in being positioned as the top side. As in the roll of conventional dice, the top side 128 is the operative side which promotes further play of the game. All of the other sides thus being ignored during that roll or turn.

Figure 3A:
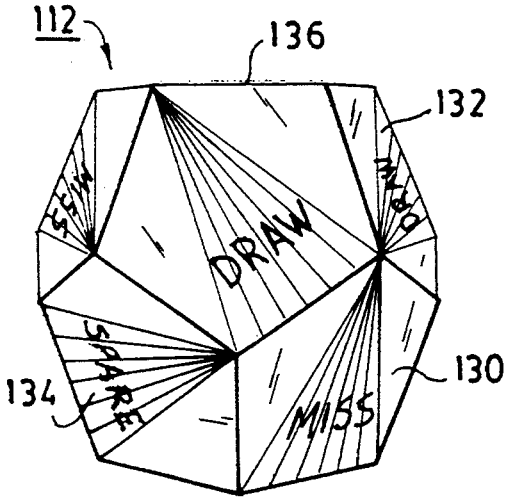
FIGS. 3A and 3B are perspective views of different sides of the action die employed in the board game of the present invention.
Figure 3B:
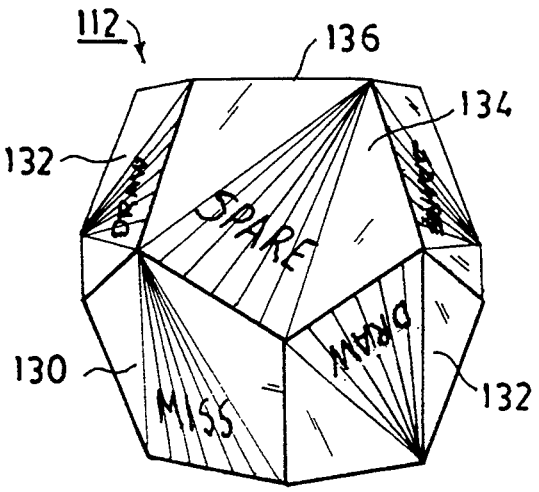

Referring now to FIGS. 3A and 3B, it is shown that the action die 112 is also a regular polyhedron having twelve sides or faces. The action die 112 includes four sides 130 each containing indicia indicating that the player has rolled a miss, four sides 132 containing indicia indicating that the player is to draw a card from the deck of percentage cards 116, and four sides 134 provided with indicia indicating that the player has rolled a spare. Similarly, after roll of the action die 112, the operative side of the die is the top side 136.

Figure 4:
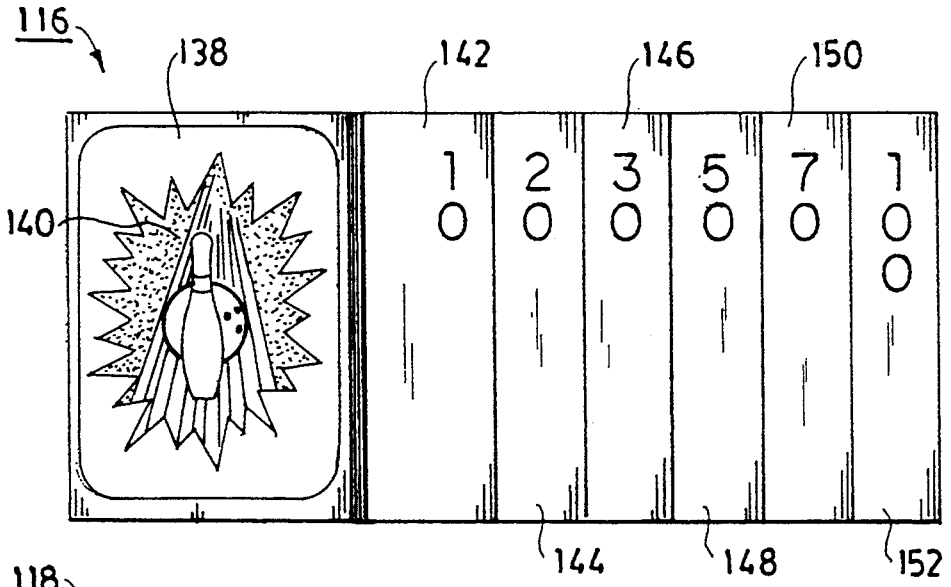
FIG. 4 is a plan view of the back side of a percentage card and the face sides of a number of illustrative percentage cards employed in the present invention.

In FIG. 4 there is shown a representative back side 138 of a particular card of the deck of percentage cards 116. The back side of each percentage card in the deck 116 includes indicia 140 which is color coded to correspond to the sides 132 of the action die 112 shown in FIGS. 3A and 3B. In the preferred embodiment of the present invention, the indicia 140 and each side 132 of the action die 112 predominantly feature the color red. In this manner, the deck of percentage cards 116 is color coded to the action die 112 such that when a red draw side 132 results top side up, the player is instructed to draw a card from the deck of red color coded cards. Referring again to FIG. 4, there is also shown a representative selection of face sides of percentage cards from the deck 116 as represented by individual cards 142, 144, 146, 148, 150 and 152. In the preferred embodiment of the present invention, the deck of percentage cards 116 includes a total of 45 cards. As represented by the face sides of the percentage cards contained in the deck 116, each of the percentage cards is provided with a percentage number which is a multiple of ten between ten and one hundred inclusive.

The following Table 1 summarizes the preferred distribution of possible percentage numbers among the 45 percentage cards, as well as the odds and probability of drawing a particular percentage number.

| PERCENTAGE CARDS | | | |
|---|---|---|---|
| Percentage Number | Quantity In Deck | Odds Of Drawing Card | Probability Of Drawing Card |
| 10 | 1 | 45:1 | .0222 |
| 20 | 1 | 45:1 | .0222 |
| 30 | 2 | 45:2 | .0444 |
| 40 | 2 | 45:2 | .0444 |
| 50 | 2 | 45:2 | .0444 |
| 60 | 3 | 45:3 | .0667 |
| 70 | 4 | 45:4 | .0889 |
| 80 | 5 | 45:5 | .1111 |
| 90 | 10 | 45:10 | .2222 |
| 100 | 15 | 45:15 | .3333 |

Figure 5:
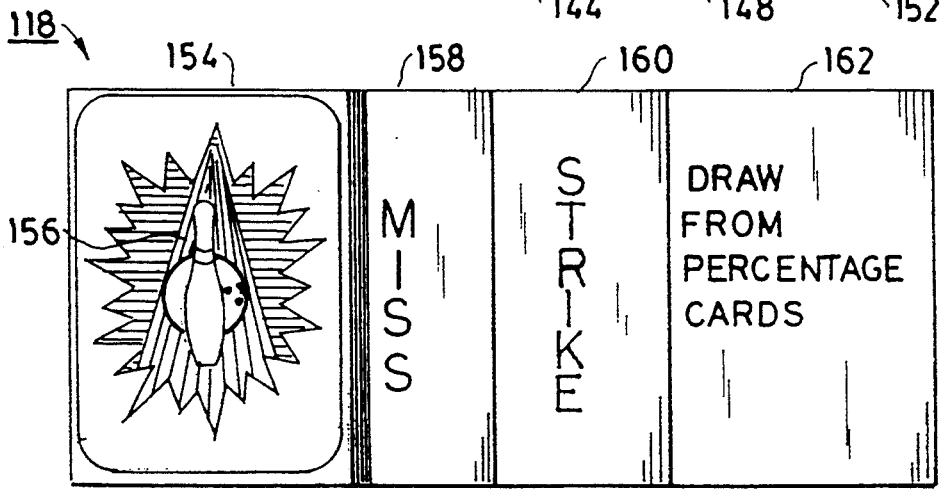
FIG. 5 is a plan view of the back side of an action card and the face sides of three of the action cards employed in the present invention, each face side illustrating one of the possible action commands.

Referring now to FIG. 5, there is shown a sample of cards from the deck of action cards 118. Card 154 shows a representative back side of each of the cards contained in the deck 118 which includes indicia 156. The indicia 156 is color coded to correspond to each of the faces 126 on the pin die 110. In the preferred embodiment of the present invention, the indica 156 on the back side of each of the action cards in the deck 118 and the draw indicia contained on each of the faces 126 of the pin die 110 predominately feature the color black. In this manner, when the pin die 110 is rolled and one of the sides 126 results in the operative top side of the die, a player will thereby be instructed to draw a card from the deck of action cards 118. FIG. 5 also shows three representative face sides of the cards in the deck 118. As shown in FIG. 5, representative card 158 contains an instruction that the player drawing the card is to record a miss, a card 160 indicates that a player is to record a strike upon drawing the card 160 and a card 162 indicates a player is to draw a percentage card from the deck of percentage cards 116. In the preferred embodiment of the present invention, the deck of action cards 118 also includes a total of 45 cards.

The following Table 2 summarizes the preferred distribution of possible action commands among the 45 action cards, as well as the odds and probability of drawing a particular type of card.

TABLE 2

| Command On Card | Quantity In Deck | Odds Of Drawing Card | Probability Of Drawing Card |
|---|---|---|---|
| | ACTION CARDS | | |
| Strike | 25 | 45:25 | .560 |
| Miss | 5 | 45:5 | .100 |
| D.P.C.* | 15 | 45:15 | .330 |

*D.P.C. = Draw Percentage Card

FIG. 6 shows the matrix chart 120 used in accordance with the board game apparatus of the present invention. The matrix chart includes a grid including ten columns 164 and ten rows 166. The columns 164 and rows 166 intersect to form the grid of the matrix chart and subdivide the grid into one hundred square regions 168. Each of the square regions 168 contains an integer between zero and ten, inclusive, as shown in FIG. 6. Each integer in the square regions 168 indicates the number of pins knocked down after a player has been instructed to draw a card from the deck of percentage cards 116. The columns 164 of the matrix chart 120 are consecutively numbered one through ten from left to right as shown in FIG. 6. Each of these numbers represent the number of pins that remain standing when the player has been instructed to draw a card from the deck of percentage cards 116 and also conveniently identifies the columns first through tenth. Each of the rows 166 of the matrix chart 120 is consecutively identified from top to bottom by one of the possible ten percentage numbers as shown in FIG. 6.

When a player has been instructed to draw a card from the deck of percentage cards 116, the number of pins recorded as knocked down for that roll is contained in the square region 168 which is common to the column indicating the number of pins that remain standing at that point of play and the row containing the percentage number corresponding to the percentage number on the back of the card drawn from the deck 116.

The score card 122 used in accordance with the present invention is shown in detail in FIG. 7. The score card 122 of FIG. 7 also contains the scoring results of play for various examples presented hereinafter.

In the preferred embodiment of the present invention, the playing surface 114 is comprised of a generally rectangular piece of felt having a rubber backing for gripping a preselected flat area such as a table top or the hard smooth surface of a floor. During play, the players are confined to rolling the dice 110 and 112 on the playing surface 114. In the event a player rolls one of the dice off of the playing surface 114, a miss is recorded. This is the equivalent of rolling a gutter ball in a bowling alley. The preferred size of the playing surface is approximately 25 inches by 30 inches as it has been determined that this predetermined size is optimum in balancing the elements of skill and chance involved in playing the bowling board game of the present invention.

Unlike the conventional cube-shaped die employed in a number of prior board games, the dice 110 and 112 of the present invention are relatively large and are of a size as to be able to comfortably fit in the hand of an average adult player. The dice of the present invention are made of any suitable material such as wood, metal or any one of a number of materials including composite materials, but are preferably made from plastic since plastic is inexpensive, lightweight and durable. In one preferred embodiment of the present invention, the dice 110 and 112 are weighted and balanced so that they may be controlled to a substantially greater degree than conventional dice which are intended to provide a completely random result. Given the balance of the relatively large dice 110 and 112, it is proposed that players will develop skill in rolling the dice. With skill and practice, a player will be able to increase the probability that any one of the sides 124 of the pin die 110 will have a greater probability of resulting top side up. Thus as players repeatedly play the game over time, their skill will develop both in not rolling gutter balls, that is rolling the dice off of the playing surface, as well as increasing the probability of rolling a higher number on the first roll of the pin die 110.

The following examples taken in conjunction with the above detailed description and the drawing will illustrate the intended method of play of the game apparatus of the present invention. While numerous possibilities may result during play, the following examples are illustrative of a broad range of these possibilities. The scoring associated with each of the following examples is shown FIG. 7.

FIRST EXAMPLE

The player first rolls the pin die 110 and after the die comes to a stop, the side 124 including the number seven results side up. The player then scores a seven in the first roll of the first frame. In accordance with play of the present game, the player then rolls the action die 112. Upon rolling the die 112, one of the spare faces 134 results top side up indicating that the player has rolled a spare by knocking down the three remaining pins on the second roll. A spare is thus recorded for the first frame of play in this example.

SECOND EXAMPLE

The player rolls the pin die 110 which results in a draw face 126 on the top side of the die. The player then draws an action card 162 from the deck of action cards 118. The action card 162 includes the action command that the player is to draw a percentage card. The player then draws a percentage card 146 from the deck of percentage cards 116. The percentage card 146 includes the percentage number 30. To determine the number of pins knocked down on this first roll, the player consults the matrix chart of FIG. 6 and refers to the square region common to the tenth column, since ten pins remain standing at this point of play, and the row containing the percentage number 30 corresponding to the number on the card drawn from deck 116. It is thus determined that three pins have been knocked down with this first roll. The player then rolls the action die 112 which results in a draw side 132 as the top side of the die indicating that the player is to draw again from the deck of percentage cards 116. The player then draws a card 152 including the percentage number 100. At this point, the matrix chart is consulted with reference to the seventh column since seven pins remain standing. The square region common to both the seventh column and the row containing the percentage number 100 corresponding to the 100 on the drawn card indicates that the player has knocked down seven pins on his second roll. Thus a spare is scored in the first frame of this example.

THIRD EXAMPLE

The player rolls the pin die 110 resulting in the face 124 containing the number nine on the top side of the die. The player then rolls the action die 112 resulting in a miss side 130 as the top side of the die. A miss is then recorded on the second roll of the first frame and nine is thus recorded as the total of the first frame in this example.

FOURTH EXAMPLE

The player rolls the pin die 110 resulting in the draw side 126 on the top side of the die. The player then draws a card 162 from the action deck 118 that includes the command to draw a percentage card. The player then draws a card 152 form the percentage deck 116 that contains on its face side the percentage number 100. To determine the number of pins knocked down on the first roll, the player consults the matrix chart referring to the tenth column, since ten pins remain standing, and to the row containing the percentage number 100. The number of pins knocked down, 10, is contained in the square region common to the above identified row and column. Thus the player records a strike in the first frame of this example.

FIFTH EXAMPLE

The player rolls the pin die 110 resulting in the draw side 126 as the top side of the die thus indicating that the player is to draw an action card from the deck 118. The player then draws an action card 162 directing the player to draw a percentage card. The player then draws a percentage card 148 containing the percentage number 50. The number of pins knocked down on this first roll in the first frame is determined by consulting the matrix chart. Referring first to the tenth column, since ten pins remain standing, and proceeding down to the square region common to the row containing the percentage number 50, it is determined that five pins have been knocked down on the first roll. The player then rolls the action die 112 which results in a draw side 132 as the top side of the die indicating that the player is to draw a card from the deck of percentage cards 116. The player then draws a percentage card 150 including the percentage number 70. To determine the number of pins knocked down on the second roll, the matrix chart is consulted again with reference to the fifth column since five pins remain standing at this point of play. The player then moves down this column to the square region common with the row containing the percentage number 70. It is thereby determined that three pins have been knocked down on the second roll, since the number three is contained in the common square region. Thus eight is recorded as the scored total in this frame of play.

SIXTH EXAMPLE

The player rolls the pin die 110 which comes to rest with the side 124 including the number one top side up. A single pin is then recorded as being knocked down on the first roll of this example. Upon rolling the action die 112, one of the draw faces 132 results on the top side thereby directing the player to draw a card from the deck of percentage cards 116. The player draws a percentage card 152 upon drawing from the deck 116. At this point in play, there are nine pins standing and the drawn percentage card contains the number 100. To determine the number of pins knocked down on this second roll, the matrix chart is consulted. It is thus determined that the player has rolled a spare since the number contained in the square region common to the ninth column and the row containing the percentage number 100 indicates that nine pins have been knocked over by the second roll.

As play proceeds in accordance with the above examples, after each time the player is instructed to draw a card it is replaced at the bottom of the corresponding deck or, alternatively, inserted into the deck at any random location. The decks of cards 116 and 118 may be reshuffled at anytime during play. The game proceeds until ten frames have been played alternating frames between players or groups of players. Each of the frames 1 through 9 includes one roll of the pin die 110 and one roll of the action die 112. The tenth frame also includes these two rolls unless the second roll results in a strike or spare. In this event, the player receives a second roll of the pin die 110 as the final roll of the game. The tenth frame totals are then calculated to determine the winning player or team.

While this board game invention has been described in detail with reference to a certain preferred embodiment and specific examples of play relating thereto, it should be appreciated that the present invention is not limited to that precise embodiment. Rather, in view of the present disclosure, many modifications and variations would present themselves to those of skill in the art without departing from the scope and spirit of this invention, as defined in the following claims.

What is claimed is:

1. An apparatus for playing a board game in which players roll dice and draw cards to simulate the action of bowling in a bowling alley and in which the object of play is to score the highest point total after ten frames of play, said apparatus comprising:

a first deck of cards, each of the cards of said first deck having a first common indicia on its back side and each of the cards of said first deck having an action command on the face side thereof;

a second deck of cards, each of the cards of said second deck having a second common indicia on its back side and each of the cards of said second deck having a percentage number on the face side thereof;

a first die having a plurality of sides, some of the sides of said first die having indicia indicating a number of pins knocked down after a roll of said first die and the remaining sides of said first die having said first common indicia indicating that a player is to draw a card from said first deck of cards; and a second die having a plurality of sides, some of the sides of said second die having indicia indicating that the player rolled a spare, or a miss, and the remaining sides of said second die having said second common indicia indicating that a player is to draw a card from said second deck of cards.

2. The apparatus according to claim 1 wherein said action command includes a strike, a miss, or an instruction to draw a card from said second deck of cards.

3. The apparatus according to claim 1 wherein said percentage number is a multiple of ten between ten and one hundred, inclusive.

4. The apparatus according to claim 1 wherein said first die is a regular polyhedron having twelve sides, each of nine predetermined sides having said indicia indicating the number of pins knocked down by including one of nine integers between one and nine, inclusive, and each of the remaining sides having said first common indicia indicating that a player is to draw a card from said first deck of cards.

5. The apparatus according to claim 1 wherein said second die is a regular polyhedron having twelve sides, each of four first predetermined sides having said indicia indicating that the player has rolled a spare, each of four second predetermined sides having said indicia indicating that the player has rolled a miss, and each of the remaining sides having said second common indicia indicating that the player is to draw a card from said second deck of cards.

6. The apparatus according to claim 1 further comprising a playing surface upon which said first or second die is rolled and wherein a player records a miss when the die rolls off said playing surface.

7. The apparatus according to claim 6 wherein said playing surface includes a generally rectangular piece of felt having a rubber backing for gripping a preselected flat area for supporting said playing surface.

8. The apparatus according to claim 7 wherein said generally rectangular playing surface measures substantially 25 inches by 30 inches.

9. The apparatus according to claim 1 further comprising a matrix chart for determining the number of pins knocked down when a player has been instructed to draw a card from said second deck of cards, said matrix chart including a grid having ten rows and ten columns whereby said grid is subdivided into a predetermined number of regions, each of said regions containing an integer between zero and ten, inclusive, to indicate a respective number of pins knocked down.

10. The apparatus according to claim 9 wherein said matrix chart further includes an eleventh row with ten regions, each of the eleventh row regions consecutively containing from left to right one of the consecutive integers between one and ten, inclusive, each of said consecutive integers for representing the number of pins that remain standing after a player has been instructed to draw a card from said second deck of cards and for ordinally identifying the columns first through tenth.

11. The apparatus according to claim 10 wherein said matrix chart further includes an eleventh column with ten regions, each of the eleventh column regions consecutively containing from top to bottom one of the consecutive multiples of ten between ten and one hundred, inclusive, each of said consecutive multiples of ten corresponding to said percentage number on the face side of each of the cards in said second deck of cards so that the number of pins knocked down is indicated by the integer in the region common to the column indicating the number of standing pins and the row containing a number corresponding to the percentage number on the card drawn from said second deck of cards.

* * * * *